US007243603B2

(12) United States Patent
Sheaffer

(10) Patent No.: US 7,243,603 B2
(45) Date of Patent: Jul. 17, 2007

(54) SHOT PATTERN CONTROL WAD STRUCTURE FOR SHOTSHELL

(76) Inventor: Clifford G. Sheaffer, 136 Teton Dr., Pittsburgh, PA (US) 15239

( * ) Notice: Subject to any disclaimer, the term of this patent is extended or adjusted under 35 U.S.C. 154(b) by 0 days.

(21) Appl. No.: 11/180,464

(22) Filed: Jul. 12, 2005

(65) Prior Publication Data

US 2007/0012212 A1 Jan. 18, 2007

(51) Int. Cl.
*F42B 7/08* (2006.01)

(52) U.S. Cl. ..... 102/449; 102/450

(58) Field of Classification Search ..... 102/448–450, 102/453, 456, 457, 532
See application file for complete search history.

(56) References Cited

U.S. PATENT DOCUMENTS

| | | | | |
|---|---|---|---|---|
| 2,953,990 | A * | 9/1960 | Miller | 102/449 |
| 3,190,220 | A * | 6/1965 | Delbert et al. | 102/449 |
| 3,565,010 | A * | 2/1971 | Sahlmann et al. | 102/453 |
| 3,721,194 | A * | 3/1973 | Weston, Jr. | 102/449 |
| 3,730,095 | A * | 5/1973 | Lage | 102/451 |
| 4,103,621 | A * | 8/1978 | Fackler | 102/453 |
| 4,506,605 | A * | 3/1985 | Maki | 102/457 |
| 4,635,555 | A | 1/1987 | Ferri | |
| 5,299,502 | A | 4/1994 | Maki | |
| 5,413,050 | A | 5/1995 | Maki | |
| 5,861,572 | A * | 1/1999 | Schuermann | 102/449 |
| 5,874,689 | A * | 2/1999 | Alkhatib et al. | 102/453 |
| 6,164,209 | A * | 12/2000 | Best et al. | 102/450 |
| 6,367,388 | B1 * | 4/2002 | Billings | 102/454 |
| 7,013,786 | B1 * | 3/2006 | Allen et al. | 86/57 |
| 2003/0164111 | A1 * | 9/2003 | Meyer et al. | 102/522 |
| 2005/0039627 | A1 * | 2/2005 | Zanoletti | 102/449 |
| 2005/0235860 | A1 * | 10/2005 | Gardner | 102/449 |

* cited by examiner

*Primary Examiner*—Troy Chambers
*Assistant Examiner*—Stewart Knox
(74) *Attorney, Agent, or Firm*—Carothers & Carothers

(57) ABSTRACT

A shot pattern control wad structure for use in a cartridge for shotgun wherein the cartridge includes a case having a tubular outer wall and a wad structure located in the case between gunpowder and a charge of pellets. The wad structure of the present invention is a two-piece structure and includes a base wad having a tubular cylindrical body open at a forward end thereof and has a closed rearward end that faces adjacent to the gun powder. The cylindrical body of the base wad is provided with slits longitudinally extending from the open forward end. The second portion of the wad structure is a shot container having a tubular cylindrical body with open rear and front ends and contains the charge of pellets and is dimensioned to be slidably received within the base wad. The open front end of the shot container has an annular inwardly restricting extrusion passage for extruded passage of the charge of pellets therethrough and the open rear end of the shot container is preferably provided with longitudinal slits.

9 Claims, 3 Drawing Sheets

SHOT PATTERN CONTROL WAD STRUCTURE FOR SHOTSHELL

BACKGROUND OF THE INVENTION

The present invention relates to the field of shotgun cartridges and more particularly to a shotshell which controls the shot pattern.

In a conventional shotgun, the barrel thereof is usually provided with a choke to control the distribution density (pattern) of the shot pellets at a predetermined shooting range. A full choke barrel provides the greatest degree of concentration of the pellets as they leave the shotgun barrel and is used for a long range shot. Other chokes of less constriction are improved cylinder and open.

A principal object of the present invention is to provide a wad structure for a shotshell which is more effective in longer range shooting, and which effect can be obtained by merely exchanging the type of shotshell as opposed to modifying the degree of choke. It is a further object of the present invention to provide a pattern control device for the pellets which provides improvement over the devices illustrated in U.S. Pat. Nos. 4,635,555; 5,299,502 and 5,413,050.

SUMMARY OF THE INVENTION

The shot pattern control wad structure of the present invention for use in a cartridge for a shotgun includes in typical fashion a case having a tubular outer wall and a wad structure located in the case between gunpowder and a charge of pellets. The wad structure of the present invention includes a base wad having a tubular cylindrical body open at a forward end thereof and having a closed rearward end face adjacent to the gunpowder. The cylindrical body is provided with slits longitudinally extending from the open forward end of the tubular cylindrical body. In addition, the wad structure further includes a shot container having a tubular cylindrical body with open rear and front ends for containing the charge of pellets. The tubular cylindrical body of the shot container is dimensioned to be slidably received within the base wad tubular cylindrical body. The open front end of the shot container is provided with an annular inwardly restricting extrusion passage for extruded passage of the charge of pellets therethrough.

The tubular cylindrical body for the shot container is preferably provided with slits longitudinally extending from the open rear end. These slits are symmetrically arranged annularly about the rear end of the tubular cylindrical body of the shot container. The depth of these slits may be varied, generally in the range of 0.25 to 0.75 inches, to thereby correspondingly regulate when the charge of pellets will extrude from the shot container forward through the inwardly restricting extrusion passage. In other words, the shorter the slits are, the less air turbulence will be created and the longer the charge of pellets will remain with the shot container. The longer these slits are the more turbulence is created about the rearward end of the shot container which causes the shot charge to extrude through the restricting extrusion passage sooner.

The base wad structure is similar to that of the prior art in that it is provided with slits which are symmetrically arranged annularly about the front or forward end of the tubular cylindrical body of the base wad so that the base wad structure flares out and departs from the shot container shortly after leaving the barrel of the gun, generally at 10 to 15 yards. These slits are generally selected to be approximately 1.5 to 2.0 inches in length. As is illustrated in FIG. 1, the base wad 10 rapidly separates from the shot container 11 at about 10 to 15 yards after leaving the shotgun barrel 12. After this initial separation, the shot container 11 continues for some distance holding the shot together and then extrudes the shot stream 13 and the shot container 11 is then left behind as indicated in the figure.

The aerodynamic and inertial forces act on the sleeve of the shot container 11 to slow its forward motion more rapidly than the shot. The shot is thus extruded into a uniform column 13 through the forward extrusion passage of the shot container 11 as the shot container 11 is withdrawn by the force of air. Thus the wad structure of the present invention compensates for the spraying effect of shotgun barrel choking systems and produces significantly more dense shot patterns. In fact, with the system of the present invention one is able to obtain a shot pattern which is 30 inches in diameter at 150 yards, whereas in most prior art systems a 30 inch diameter pattern can be attained only at a maximum range of approximately 40 yards. The result is that a more dense shot pattern is obtained and this reduces unnecessary wounding of game birds and insures a quick and sure kill even at long ranges of 150 yards or more.

BRIEF DESCRIPTION OF THE DRAWINGS

The accompanying drawings show, for the purpose of exemplification, without limiting the scope of the invention or appended claims, certain practical embodiments of the invention wherein:

DETAILED DESCRIPTION OF A PREFERRED EMBODIMENT

Figure 1:
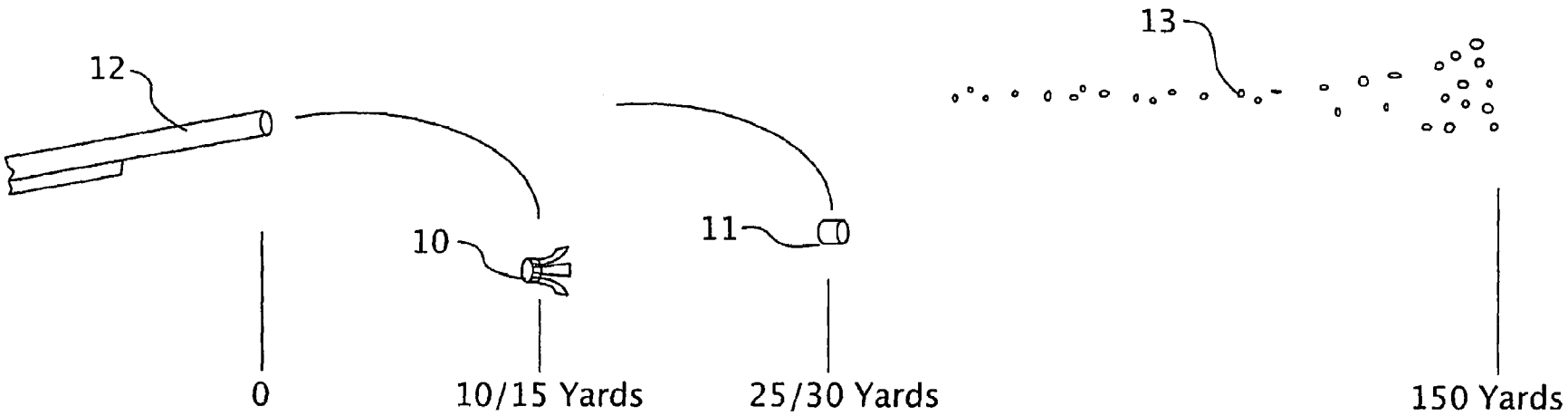
FIG. 1 is a schematic illustration showing the device of the present invention being fired from a shotgun.
Figure 2:
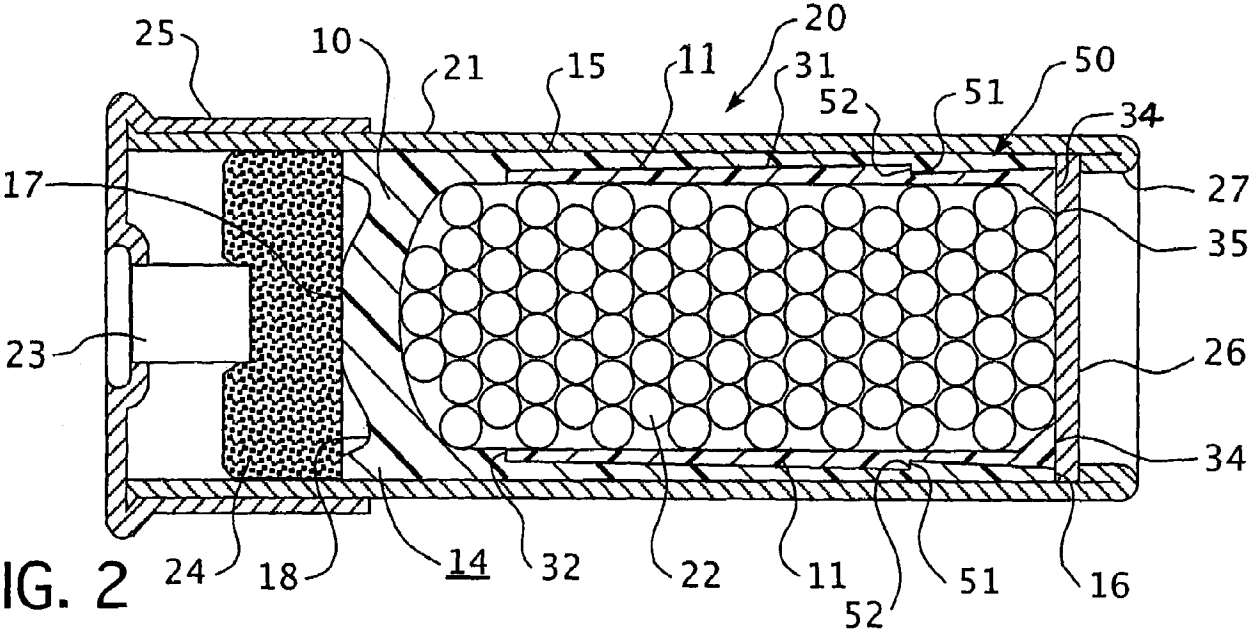
FIG. 2 is a view in side elevation of a shotshell incorporating the wad structure of the present invention as shown in vertical mid cross section.
Figure 4:
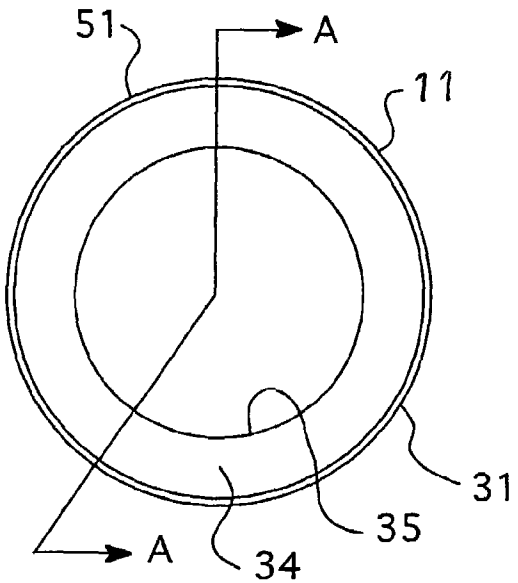
FIG. 4 is a right end view of the shot container shown in FIG. 3 which defines the shot extrusion passage.
Figure 3:
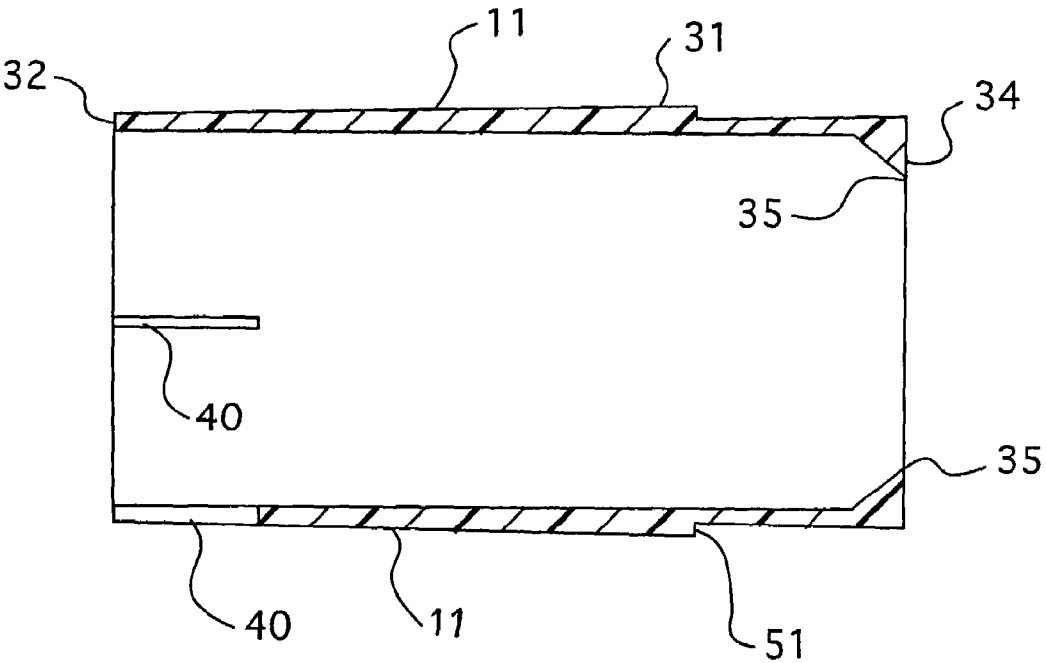
FIG. 3 is a view in side elevation of the shot container portion of the wad structure of the present invention as seen in section along line A-A of FIG. 4.
Figure 6:
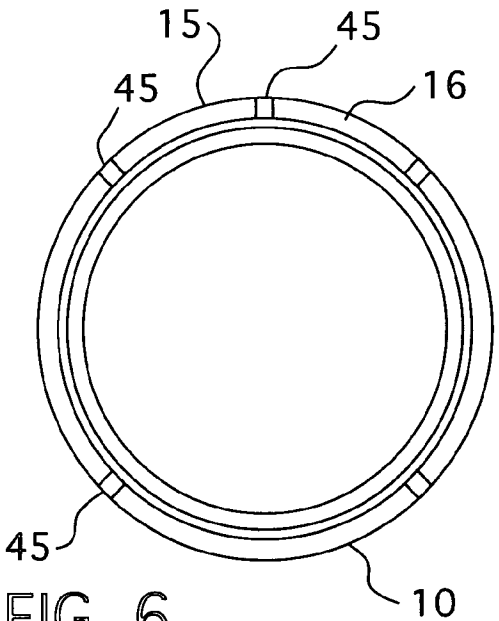
FIG. 6 is a right end view of the base wad portion shown in FIG. 5.
Figure 5:
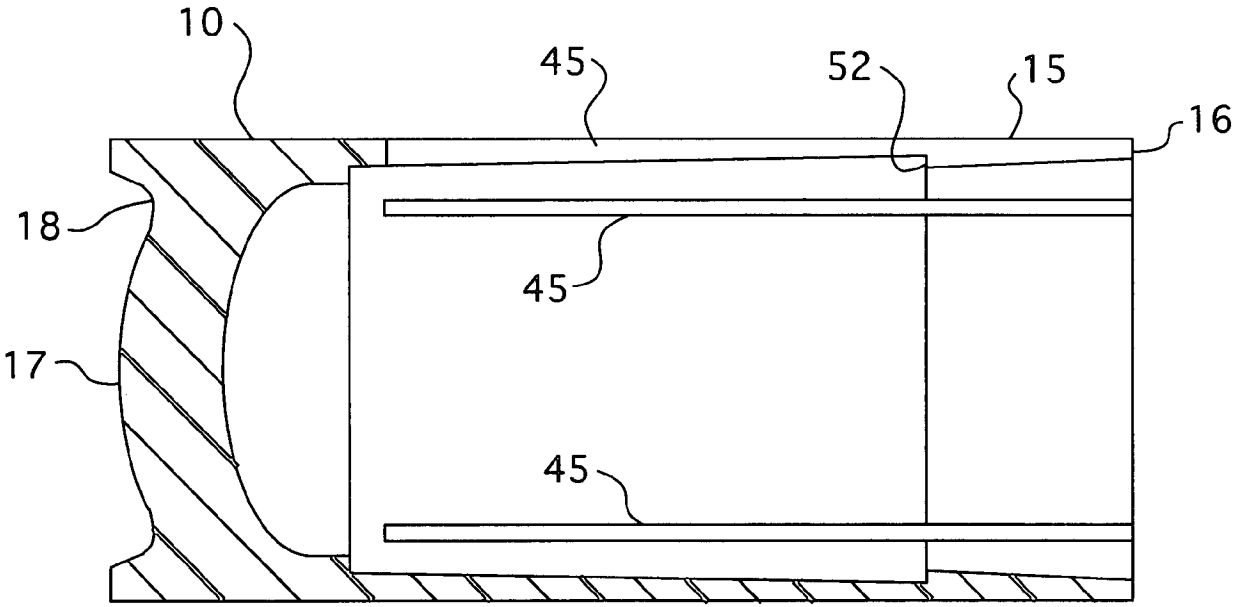
FIG. 5 is a view in side elevation of the base wad portion of the wad structure of the present invention as seen in vertical mid cross section.

Referring to FIGS. 2 through 5, a shotshell 20 is illustrated which is charged in accordance with the teachings of the present invention. The shotshell 20 includes a tubular plastic or paper case 21, shot 22, primer 23, powder 24 and a metal head 25. The wad structure 14 contained within case 21 is a two-piece structure of the present invention and is held in position within the case 21 by means of end cap 26 and crimp 27.

The two-piece wad structure 14 includes a one-piece base wad 10 constructed of plastic and having a tubular cylindrical body 15 open at its forward end 16 and having a closed rearward end face 17 adjacent the gunpowder 24. Face 17 is also provided with an annular compression groove 18.

The second part of the wad structure 14 is comprised of shot container 11 which is also constructed of plastic and is provided with a tubular cylindrical body 31 with open rear and front ends 32 and 34 respectively for containing the charge of pellets 22. Tubular cylindrical body 31 is also dimensioned to be slidably received within the cylindrical body 15 of base wad 10. The open front end 34 of shot container 11 is provided with an annular inwardly restricting extrusion passage 35 for extruded passage of the charge of pellets 22 upon firing of the shotgun as previously explained.

The tubular cylindrical body 31 of shot container 11 has slits 40 longitudinally extending from the open rear end 32 are symmetrically arranged annularly about end 32, and the slits are approximately 0.25 to 0.75 inches long. The length of these slits correspondingly regulates when the charge of pellets 22 will extrude from shot container 11 through extrusion passage 35.

The shotshell illustrated in FIGS. 2 through 5 is a 10 gauge shell. However, the principals of the present invention may be applied to any conventional shotgun gauge such as gauges 12, 16 and 20.

Generally six slits 40 are provided in the tubular cylindrical body 31 thereby correspondingly providing six tabs therebetween which tend to flutter while the shot container 11 travels through the air. This fluttering causes resistance and slows up the container 11 so that the shot 22 will extrude forward through the inwardly restricting extrusion passage 35 to form the extruded shot column illustrated in FIG. 1 at 13.

The longer the slits 40 are the more turbulence is created by the tabs provided between the slits 40 and the sooner the shot container 11 will extrude its contained pellets 22. Thus, for extremely long shots of 150 yards, the slits 40 will be made shorter so that the pellets 22 are retained in container 11 for a longer period of time before they extrude therefrom.

The base wade structure 10 is provided with slits 45 which are symmetrically arranged annularly about the forward end 16 and longitudinally extend from the open forward end 16 to a selected distance of approximately 1.5 to 2.0 inches in length, depending upon the gauge size of the shotgun shell 20. Generally five slits 45 are provided thereby providing therebetween five flaps which tend to peel open as illustrated in FIG. 1 when the shotshell 20 is fired in the shotgun 12 which thereby causes the base wad structure 10 to drop off thereby leaving the shot container 11 to travel on.

An interlocking retainer means 50 is provided between the base wad 10 and the shot container 11 in the form of annular shoulder 51 of shot container 11 which mates with annular protruding lip 52 of base wad 10. Thus when the combination of base wad 10 and shot container 11 are combined within the shot shell 20, and additionally in the barrel of a shotgun after leaving the shot shell they are always maintained together by this interlocking retainer mechanism until the combination has left the barrel of the shotgun. Upon leaving the barrel of the shotgun then the leaves provided between slots 45 of base wad 10 are then permitted to spread open and release the shot container 11 contained therein.

I claim:

1. A shot pattern control wad structure for use in a cartridge for a shotgun, said cartridge including a case having a tubular outer wall, said wad structure located in said case between gunpowder and a charge of pellets, said wad structure comprising:

a base wad having a tubular cylindrical body open at a forward end thereof and having a closed rearward end face adjacent to the gunpowder, said cylindrical body having slits longitudinally extending from said open forward end;

a shot container having a tubular cylindrical body with open rear and front ends for containing the charge of pellets and dimensioned to be slidably received within said base wad, said open front end having an annular inwardly restricting extrusion passage for extruded passage of said charge of pellets therethrough; and an interlocking retainer means between said base wad and said shot container for preventing forward advancement of said base wad from said shot container until after the combination has left the barrel of the shotgun, said interlocking retainer means including an annular inwardly protruding and rearwardly facing shoulder on said base wad tubular cylindrical body engaging a forwardly facing shoulder on said shot container cylindrical body at right angles to the forward direction of said base wad and shot container.

2. The shot pattern control wad structure of claim 1, wherein said tubular cylindrical body for said shot container has slits longitudinally extending from said open rear end.

3. The shot pattern control wad structure of claim 2, wherein said slits in said shot container are symmetrically arranged annularly.

4. The shot pattern control wad structure of claim 3, wherein said shot container slits are preselected from within the approximate range of 0.25 to 0.75 inches long to thereby correspondingly regulate when said charge of pellets will extrude from said shot container.

5. The shot pattern control wad structure of claim 1, wherein the surface of said end face which faces said gunpowder has an annular recess.

6. The shot pattern control wad structure of claim 1, wherein said base wad slits are symmetrically arranged annularly.

7. The shot pattern control wad structure of claim 6, wherein said base wad slits are preselected to be approximately 1.5 to 2.0 inches in length.

8. The shot pattern control wad structure of claim 1, wherein said base wad and shot container are plastic.

9. The shot pattern control wad structure of claim 1, wherein said extrusion passage may be varied in diameter to control the shot pattern.

* * * * *